US007837450B2

(12) United States Patent
Moreland

(10) Patent No.: US 7,837,450 B2
(45) Date of Patent: Nov. 23, 2010

(54) WATER WELL PUMP

(76) Inventor: Jerry "Jay" Moreland, 221 Antoine, Amarillo, TX (US) 79119

( * ) Notice: Subject to any disclaimer, the term of this patent is extended or adjusted under 35 U.S.C. 154(b) by 380 days.

(21) Appl. No.: 11/655,032

(22) Filed: Jan. 18, 2007

(65) Prior Publication Data

US 2007/0166178 A1 Jul. 19, 2007

Related U.S. Application Data

(60) Provisional application No. 60/759,678, filed on Jan. 19, 2006.

(51) Int. Cl.
*F04B 35/04* (2006.01)

(52) U.S. Cl. ..... 417/423.3

(58) Field of Classification Search ..... 417/423.3, 417/430; 418/213
See application file for complete search history.

(56) References Cited

U.S. PATENT DOCUMENTS 3,116,696 A * 1/1964 Deters ..... 415/140
3,521,970 A * 7/1970 Deters ..... 417/423.3
4,162,137 A 7/1979 Bjerke ..... 417/405
5,201,848 A 4/1993 Powers ..... 415/199.1
5,413,457 A * 5/1995 Tuckey ..... 415/55.6
6,361,272 B1 3/2002 Bassett ..... 415/121.1
6,439,833 B1 * 8/2002 Pickelman et al. ..... 415/55.1
6,443,715 B1 * 9/2002 Mayleben et al. ..... 417/423.1
6,926,504 B2 8/2005 Howard ..... 417/417
2003/0124005 A1 * 7/2003 Bostwick et al. ..... 417/366
2005/0249613 A1 * 11/2005 Jordan et al. ..... 417/390

OTHER PUBLICATIONS

"Tesla Pump Brochure," Dec. 1, 1998, 7 pages.

* cited by examiner

*Primary Examiner*—Devon C Kramer
*Assistant Examiner*—Bryan Lettman
(74) *Attorney, Agent, or Firm*—Charles D. Gunter, Jr.

(57) ABSTRACT

A water well pump is shown which uses regenerative turbine technology. A submersible electric motor has an output shaft which drives multi-stage regenerative turbine stages of the pump. The various stages are made up of turbine impellers separated by intermediate plates. The turbine impellers have peripheral vanes which cooperate with surrounding scraper rings to form flow channels through the regenerative section of the pump and impart energy to the water passing through the pump. The pump can be powered by a low energy source, such as a solar panel.

7 Claims, 4 Drawing Sheets

WATER WELL PUMP

CROSS REFERENCE TO RELATED APPLICATIONS

The present applications claims priority from a provisional application Ser. No. 60/759,678, filed Jan. 19, 2006, entitled "Lazarus Pump", by the same inventor.

BACKGROUND OF THE INVENTION

1. Field of the Invention

The present invention relates generally to water well pumps and, more specifically, to a vertically-stacked, multi-staged, regenerative turbine pump for a water well which can be solar powered, AC or DC powered, or solar/wind energy powered.

2. Description of the Prior Art

In most rural environments, water wells are a given necessity. Well pumps are the modern day equivalent of windmills, which were historically used to move water from one location or one depth to another. In addition to providing water for such everyday activities as showering, doing laundry and running the dishwasher, well pumps are also used at the present time for such diverse purposes as irrigating crops, providing livestock with water, supplying water to remote locations, or for acting as heating and cooling mechanisms for geothermal systems.

Two of the commonly used well pumps at the present time are the electric submersible pump and the reciprocating plunger well pump. Various designs of reciprocating plunger well pumps have been developed of more or less the same general type having a pump which is mounted at the lower end of a well pipe string and also having a reciprocating plunger or piston connected to an elongated rod extending to an actuating mechanism at the earth's surface. The pumps also include a cylinder in which the plunger reciprocates to displace fluid from a plunger cavity and is controlled by cavity inlet and discharge valves mounted on the cylinder and on the plunger, respectively.

In spite of the relatively highly developed state of the art in reciprocating plunger well pumps, certain problems in the operation of these pumps persist. These types of pumps load and release with each cycle. In particular, when the pumps are stopped, water hammer develops, which is an unwanted noisy and shaking condition of the pump. Further, the balls in many pumps are steel. Therefore, when the seat that the ball rests on becomes worn and damaged by the constant beating from the ball, erosion from abrasives, corrosion, chipping, or flaking, the steel balls cannot seal the pump and there is unwanted water leakage related to the inability to perform required, specialized service.

As a result of some of these shortcomings, a large number of homes in the United States use electric submersible pumps at the present time. The electric submersible pump is installed in the wellbore, below the water line. A small electric motor is also installed in the wellbore, usually below the pump itself, and an electric cable is attached to the motor and run to the well surface. Piping is then fitted from the pump, through the length of the wellbore and into the home. Submersible well pumps may be set hundreds of feet in depth within the wellbore. Activation of the electric motor though the downhole cable causes the pump to push water upwardly through the piping to the well surface.

Submersible pumps are typically long cylinders some three to five inches in diameter and two to four feet long. Such well pumps may be powered by alternating current, solar power, wind power, water power, or even manually. In some remote locations, it is not practical to have an electrical power supply from an electric power company. Therefore, alternative sources of energy, such as the use of solar energy, batteries or wind power are preferred. This is especially true in the case of such applications as pumping water at remote locations, such as to water livestock.

One type of water pump of the general "turbine-type" classification are the so-called centrifugal pumps. Centrifugal pumps are quite well known and are used in a variety of different fluid pumping applications. However, such turbine-type pumps can be inefficient in building a pressure head for a given flow rate and require more electrical power to operate than a positive displacement pump of equivalent capacity. In the case of solar-powered pumps, this requires a greater number of solar cells to operate. This is a disadvantage because the solar cells are expensive and more area must be provided to accommodate them.

There are a large number of references in the patent literature to submersible well pumps. For example, U.S. Pat. No. 4,162,137 shows a submersible, hydraulically-driven pump rotating about a vertical axis, the pump having a short shaft between the hydraulic motor and the impeller of the pump. The apparatus uses a cofferdam around the hydraulic pipe and the hydraulic motor, formed as three consecutive chambers around the shaft.

U.S. Pat. No. 6,361,272 B1 shows a submersible centrifugal pump for downhole pumping of methane-saturated water from wells drilled in coal formations. The pump has an electric motor-driven vertical shaft with centrifugal impellers distributed there along, each impeller being located in a stationary diffuser within the pump to form a multi-stage pump.

U.S. Pat. No. 6,926,504 shows a submersible electric pump comprising a stator and a stator housing, along with an armature and an armature housing. The stator and armature are assembled in connectable and interchangeable sections called "modules" that can be attached in series.

U.S. Pat. No. 5,201,848 is an electrical downhole pump for pumping fluids from a deep well. The pump has a relatively small diameter pump housing which is suspended from a tubing string and including a series of impellers and diffusers. The impellers are mounted on a vertical shaft connected to a motor for driving the impellers relative to the diffusers on the housing. A first group of impellers are arranged to move freely longitudinally on the shaft while a second group are fixed to the shaft to prevent relative longitudinal motion.

The above references are intended merely to be representative of the large variety of different submersible pump devices which have been employed in the past and which suffer, in one way or another, from the various shortcomings discussed above. Efforts to eliminate the above-mentioned shortcomings, while providing a well pump which is relatively inexpensive to manufacture and is reliable in operation, have not been entirely successful and further improvements in such pumps have long been sought. It is to these ends that the present invention has been developed, particularly for use in water wells, although conceivably other fluids could be pumped as well.

A need exists, therefore, for an improved water well pump which is economical to manufacture and which is reliable in operation, which can conveniently be powered by harvested energy sources, such as by solar power with a battery backup, by solar power directly, by wind power, etc.

A need also exists for such a pump which has particular application for lower capacity, high head applications, such as a water well for watering livestock at a remote location with a low production well.

A need also exists for a water well pump which incorporates regenerative turbine technology into traditional electric submersible pump applications.

SUMMARY OF THE INVENTION

The pump of the present invention solves these problems by providing a solar-powered, electric submersible turbine pump of a particular kind not previously used in the water well industry for the application presently envisioned. This type pump is referred to herein as the electric submersible regenerative turbine well pump. The efficiency of such a pump is considerably greater than that of centrifugal pumps for the intended applications, and therefore a considerably smaller investment is necessary in cost and space for the solar panels or other forms of power necessary to drive it. Also, the pump of the present invention is adaptable for use with conventional power supplies, and the greater efficiency of the pump insures lower operating costs in such instances.

The electric submersible regenerative turbine pump of the invention is specifically designed for water wells, but would also be applicable for pumping other liquids for other applications. The pumping apparatus is positioned in the well at a desired depth within the surrounding subterranean formation, usually near the bottom, and is powered by electricity delivered through wires from the surface. Liquid is drawn in from the well and is pumped up a discharge pipe or conduit to the surface.

In the preferred embodiment, the pump comprises an electric motor positionable within the wellbore and having an associated supply cable extending from the well surface to the downhole location for supplying electric current to the motor. The electric motor has a rotatably driven output shaft, the shaft extending outwardly from the motor generally along a central axis of the wellbore. A pump sleeve and an associated suction case are generally aligned along the axis of the motor output shaft, the suction case having at least one opening for receiving well water. The suction case carries a pleated filter screen and velocity reduction tube for filtering large debris from the water entering the pump. A plurality of regenerative turbine stages are contained in a stacked arrangement within the pump sleeve and coupled to the shaft for rotary motion as the motor drives the shaft.

The regenerative turbine stages form a regenerative turbine section of the pump having an inlet for receiving well water from the suction case and having an outlet port connected to the surface plumbing for supplying well water to the surface location. The regenerative turbine stages include a series of impellers separated by intermediate plates, the impellers having a series of peripheral turbine vanes located on each of opposing sides thereof for moving water through the regenerative turbine section of the pump. Water enters the regenerative turbine section at an inlet location near an outside diameter of each impeller plate, is accelerated about the periphery of the impeller plate before then exiting at a radial location which is at or near the same radial location on the impeller plate as the inlet location. The pump can be conveniently powered from a harvested energy source such as by solar panels or by windmill generated energy sources.

The preferred regenerative turbine section of the pump comprises a base plate and a discharge plate, and a plurality of impellers located there between, the impellers being separated by intermediate plates, and wherein the base plate contains the inlet port and the discharge plate contains the outlet port from the regenerative turbine section of the pump. Each impeller plate is surrounded peripherally by a scraper ring which is held in position by upper and lower intermediate plates. The scraper ring surrounds and mates with the impeller plate to form a circumferential channel for regenerated water to pass about as it passes between the inlet port and the outlet port of the regenerative section of the pump.

The preferred scraper rings each have at least one scallop at a given interior circumferential location about the periphery of the ring which forms an inlet and outlet path for regenerated water as it passes through one stage of the multi-stage regenerative section of the pump. Each intermediate plate has opposing planar faces, and wherein each opposing planar face is equipped with a plurality of centrally located thrust towers which are arranged in a circumferential pattern on each planar face. The thrust towers serve to support the impellers while allowing rotational movement of the impellers relative to the scraper rings within the regenerative turbine section of the pump.

The improved pump of invention can be used to pump water from a downhole subterranean location within a wellbore to a surface location. The previously described electric submersible pump is located within the wellbore at a selected depth. The supply cable extends from the well surface to the downhole location for supplying electric current to the pump. Associated plumbing runs from the discharge outlet of the pump to the well surface for supplying water to the surface. The pump operates as a multi-stage, regenerative turbine pump which has a plurality of regenerative turbine stages arranged in-line along a vertical axis generally parallel to a central axis of the wellbore. Water enters the regenerative turbine section of the pump at an inlet location near an outside diameter of each impeller, is accelerated about the periphery of the impeller before then exiting at a radial location which is at or near the same radial location on the impeller as the inlet location.

Additional objects, features and advantages will be apparent in the written description which follows.

DETAILED DESCRIPTION OF THE INVENTION

Figure 1:
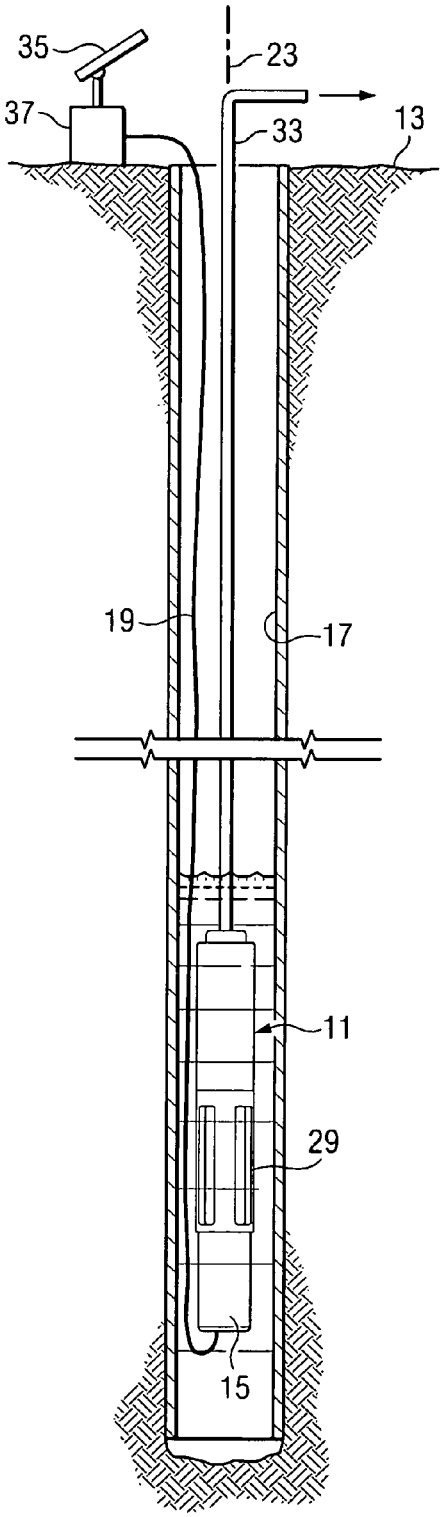
FIG. 1 is a simplified view of a water well having an electric submersible pump of the invention installed therein.

The present invention utilizes an electric submersible "regenerative" turbine pump as a basis of the water delivery system. The term "regenerative turbine pump" is used as a term of art in the discussion which follows and is specifically intended to distinguish other forms of "turbine" pumps, such as those which operate generally along the lines of centrifugal pumps. Regenerative turbine pumps are sometimes referred to in the same general category of pumps known as centrifugals. While this type of pump does borrow many of its operating principles from the "garden variety" centrifugal pump, the similarities end there because its performance characteristics are substantially different. Regenerative turbine pumps are designed to optimize head rise at relatively low flow conditions. As such, regenerative turbine pumps are sometimes categorized as low specific speed pumps which offer users better head rise and efficiency when compared to standard centrifugal pumps in similar applications.

In a common centrifugal pump, the fluid enters the center of the impeller, sometimes referred to as the "eye", and is given a "push" by one of usually about 4 to 8 rotating vanes, which impart a centrifugal force on the fluid. This fluid force is collected at a point near the periphery of the impeller, sometimes referred to as the "volute", and is redirected towards the pump discharge to provide flow and pressure.

In a regenerative turbine, on the other hand, the fluid enters the impeller much closer to its periphery where the first of a set of somewhere between about 25 and 120 very small vanes gives the fluid a small push of centrifugal force in the radial direction towards the impeller periphery. However, instead of collecting the fluid force and redirecting it immediately out the pump discharge as in the centrifugal pump, the water channel, which surrounds the turbine impeller, is shaped to deflect the fluid in a circular path back towards the inside diameter of the impeller vanes. Here it receives a second push of centrifugal force that increases the fluid velocity, and hence the potential pressure capability of the fluid. The term generally used to describe these multiple circular or helical round trips is called "regeneration", and hence the name for the regenerative turbine. This regeneration principle is the key to the high pressure-producing characteristic of the regenerative turbine versus the centrifugal pump.

Applicant's unique regenerative turbine design is ideally suited for applications where high pressure, low flow, and compact design are desired, such as a water well. The typical pressure versus flow (head-capacity) curve of Applicant's regenerative turbine is very steep, so, these pumps can easily overcome line restrictions, such as temporary blockages, or the friction of long lengths of piping or tubing. The steep pressure characteristics of the pump also means that large changes in pressure have relatively little effect in flow rate. The design also offers pulsation free flow as compared to a typical positive displacement pump. That is, the regenerative design of Applicant's pump is free from the vibration, mechanical damage, and cavitation effects typical of positive displacement pumps. As has been mentioned, positive displacement pumps also tend to be mechanically intensive and often have friction and wear problems that increase maintenance and repair costs. Applicant's regenerative turbine pump does not suffer from either of these shortcomings.

The unique features of Applicant's design will now be described in greater detail. With reference to FIG. 1 of the drawings, there is shown a typical water well installation such as might be found on a ranch for watering livestock. The well installation features an electric submersible pump 11 of the invention which is located at a subterranean location beneath the well surface 13.

An electric motor 15 is positionable within the wellbore 17 and has an associated electrical supply cable 19 extending from the well surface 13 to the downhole location for supplying electric current to the motor. The electric motor 15 has a rotatably driven output shaft 21 (FIG. 2), the shaft 21 extending outwardly from the motor generally along a central axis 23 of the wellbore and of the pump. The housing of the motor 15 is generally cylindrical and sized to be received within, for example, a minimum four inch schedule 40 PVC casing.

Figure 2:
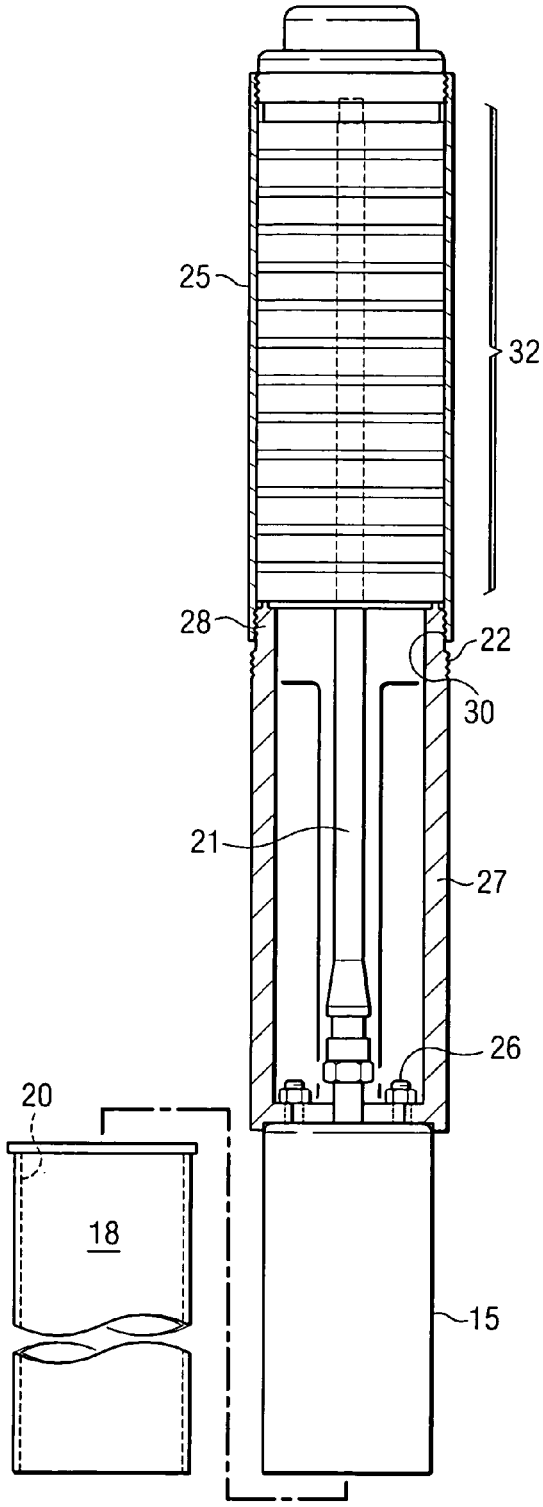
FIG. 2 is a side view, partly in section, of the submersible pump of FIG. 1.
Figure 3:
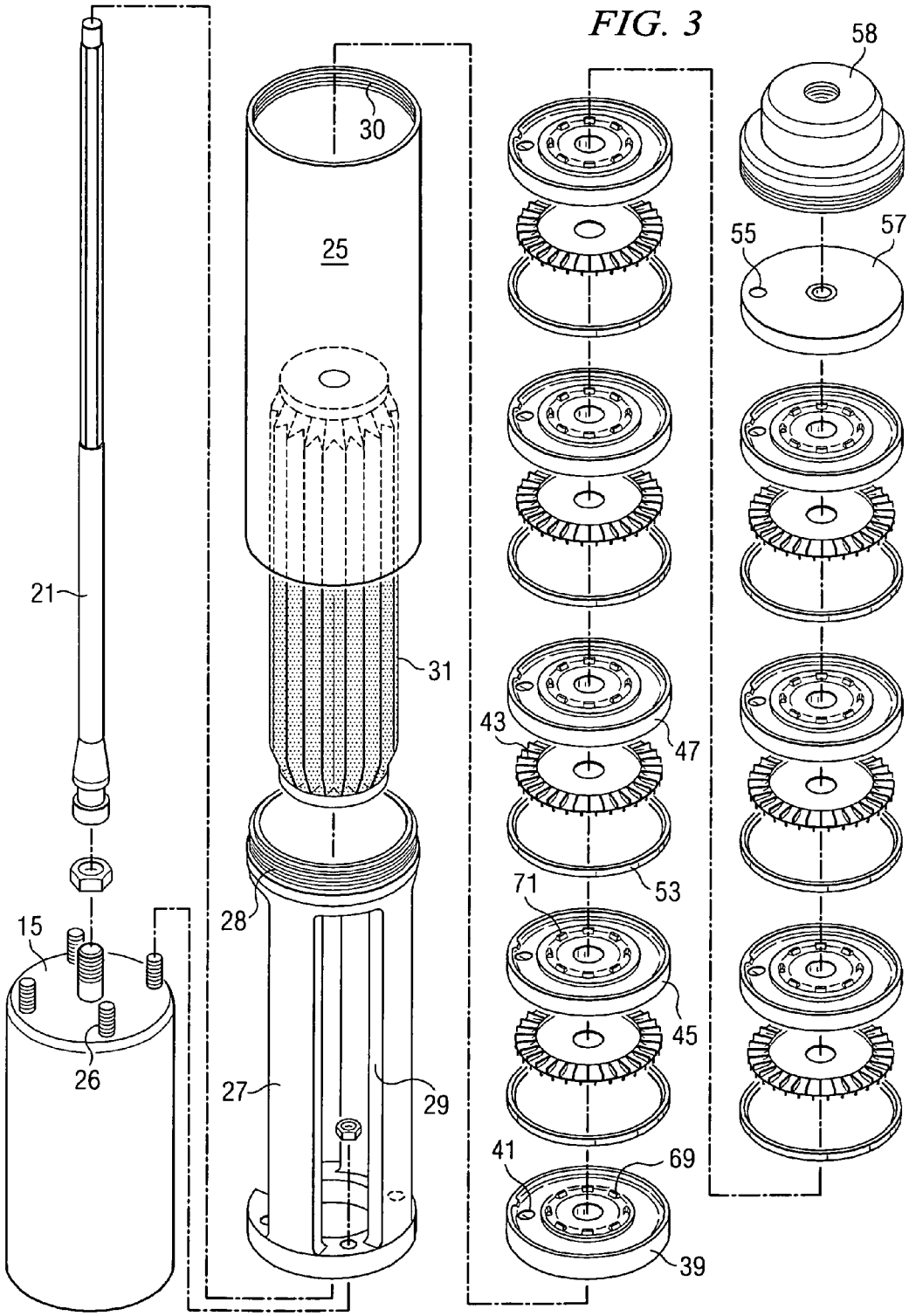
FIG. 3 is an exploded view of the pump of the invention, showing the component parts thereof.

As seen in FIG. 2, a cylindrical pump sleeve 25 and downwardly depending associated suction case 27 are generally aligned along the axis 23 of the motor output shaft. The suction case 27 is held in place by bolts 26 and has an externally threaded upper extent 28 which matingly engages the internally threaded lower extent 30 of the pump sleeve 35. The suction case has at least one longitudinal sidewall opening 29 for receiving well water. Preferably, there are a plurality of longitudinal sidewall openings. As best seen in FIG. 3, the suction case 27 can be fitted with, e.g., a 40 micron 0.0015 inch) pleated stainless steel cartridge sediment screen 31, which with the given dimensions provides more than 82 square inches of surface area.

As also shown in FIG. 2, the pump can be equipped with a velocity reduction tube which drops the velocity of the water to a point at which most entrained sediment will drop out of the flow stream. In the example illustrated, the velocity reduction tube 18 is a cylindrical member having an open interior. The upper end is internally threaded with VRT threads 20 which matingly engage a set of external threads 22 provided on the exterior of the suction case 27. The velocity reduction tube may be on the order of three feet or more in length.

As shown in FIG. 2, a plurality of regenerative turbine stages (generally at 32 in FIG. 2) are contained in a stacked arrangement within the pump sleeve 25 and or coupled to the shaft 21 for rotary motion as the motor 15 drives the shaft. The regenerative turbine stages, to be described in greater detail, form a regenerative turbine section of the pump having an inlet for receiving well water from the suction case 27 and having an outlet port connected to the surface plumbing (33 in FIG. 1) for supplying well water to the surface location. As further illustrated in FIG. 1, the power source for the electric motor 15 can conveniently be a harvested energy source such as a solar panel 35 or a windmill generated energy source.

The system will also typically feature a control system which is indicated by the control box 37 in FIG. 1. Conventional well pumping systems have the downhole pump connected by the plumbing pipes to a water storage tank which, in turn, is connected to the water distribution system. A typical control system includes a pressure of float switch that is connected to the pipes and responds to the water pressure or level in the storage tank. The switch turns the electric motor 15 on and off to maintain the water pressure in the tank within a preset pressure range. In a preferred form of the control system, the system includes a microprocessor controlled variable frequency drive for the pump motor. The demand requirement is sensed and varies the drive speed of the motor, in known fashion.

Figure 9:
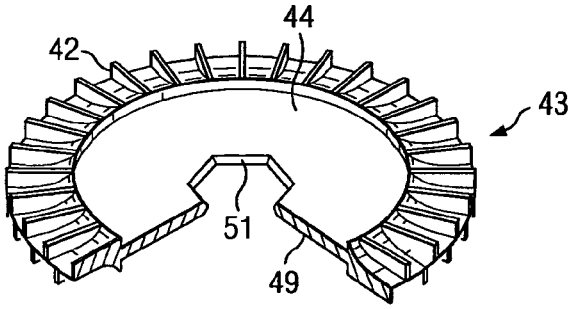
FIG. 9 is an isolated view, partly broken away, of a turbine impeller used in the regenerative turbine section of the pump.
Figure 10:
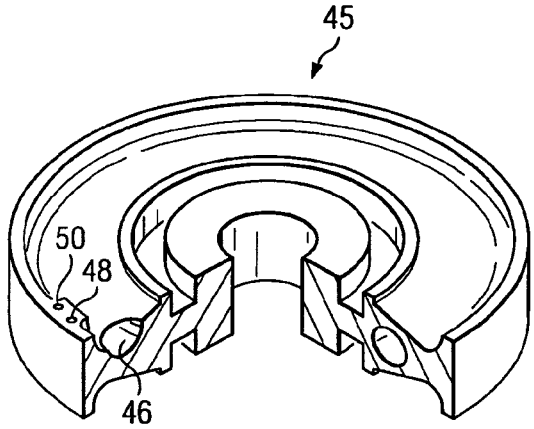
FIG. 10 is an isolated view, partly broken away, of an intermediate plate of the pump of FIG. 3.

FIG. 3 shows the various components of the regenerative turbine section of the pump in exploded fashion. A base plate 39 has an inlet port 41 for admitting water from the suction case. A plurality of impellers 43 are separated by intermediate plates 45, 47. FIG. 10 is an isolated view of one of the intermediate plates 45 showing the internal port 46 and timing pin openings 48,50. The impellers 43 have a series of peripheral turbine vanes (42 in FIG. 9) located on each of opposing sides 44, 49 thereof for moving water through the regenerative turbine section of the pump. In the particular embodiment illustrated, the impeller is approximately 2.75 inches in outside diameter and 0.050 inches thick. There are 32 vanes on each of the opposing sides with a blade length of approximately 0.550 inches and a blade height of approximately 0.250 inches. These dimensions are intended to be exemplary only. The impeller also has a polygonal central opening 51 for engaging the spline shaft 21.

Each impeller is surrounded peripherally by a scraper ring 53 (FIG. 3) which is held in position by the upper and lower intermediate plates 45, 47. The scraper ring 53 mates with the impeller to form a circumferential channel for regenerated water to pass about as it passes between the inlet port and an outlet port (55 in FIG. 3) located in a discharge plate 57 which feeds the discharge head 58.

Figure 6:
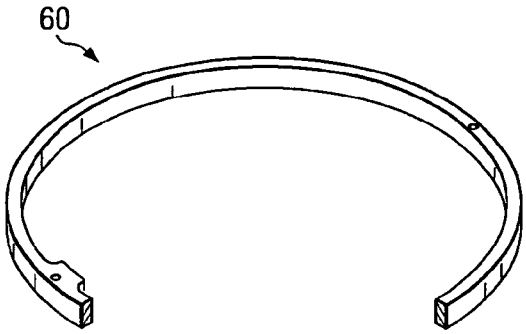
FIG. 6 (PRIOR ART)
FIGS. 6-8 are isolated views, partly broken away, of various versions of the scraper rings which are used in the regenerative turbine section of the pump.
Figure 7:
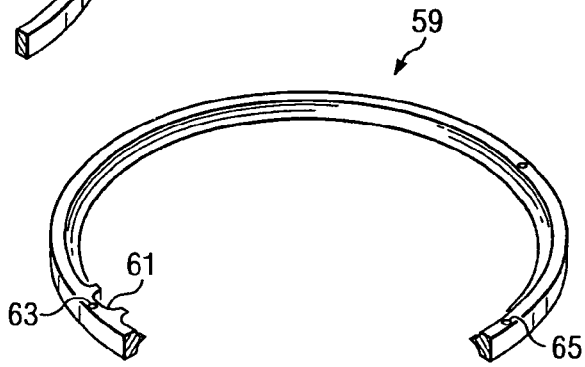
Figure 8:
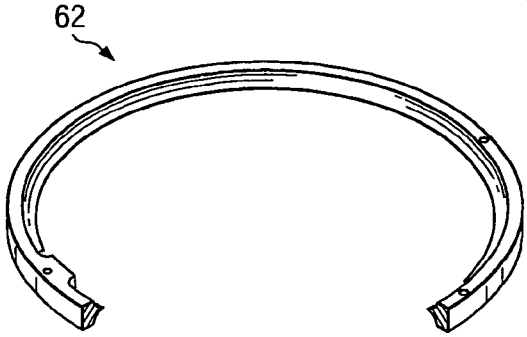

FIGS. 6-8 show three different types of scraper rings which can be utilized in the regenerative turbine section of the pump labeled as 59, 60 and 62. Each of the scraper rings, such as ring 59 in FIG. 7 includes at least one scallop 61 at a given interior circumferential location about the periphery of the ring. The scallop 61 forms an inlet and outlet path for regenerated water as it passes through one stage of the multi-stage regenerative section of the pump. The ring also has openings 63, 65, for timing pins (not shown). For the example previously given, the scraper ring might be, for example about 3.550 inches in outer diameter and 2.750 inches in internal diameter. The various components of the regenerative section can be formed, as by injection molding from a suitable plastic, such as DELRIN™, a polyoxymethylene plastic manufactured by E.I. du Pont de Nemours and Company in the United States. Each of the bottom plate, intermediate plates and discharge plates also has timing pins openings (see opening 65, 67 in FIG. 4) for aligning the scraper rings. The scraper ring 59 mates with the impeller to form a circumferential channel for regenerated water to pass about as it passes between the inlet port and the discharge outlet port 55. FIG. 6 illustrates a conventional scraper ring while FIG. 7 illustrates a parallel configuration and FIG. 8 illustrates an in-series configuration. Each of these various configurations can be substituted for use in the regenerative pump section as described above. Although shown as discrete components, it will be understood that the scraper rings could be formed as an integral part of the intermediate, discharge and suction plates.

Figure 4:
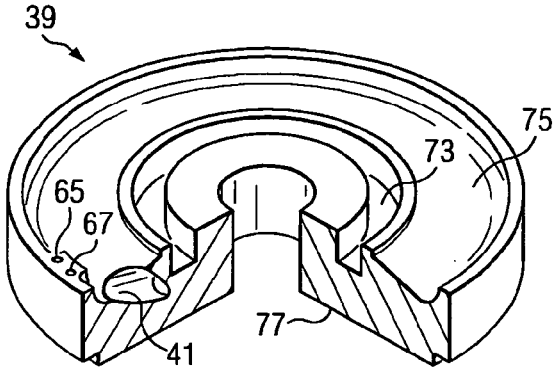
FIG. 4 is an isolated view of the of the base plate of the regenerative turbine section of the pump of FIG. 3, partly broken away for ease of illustration.
Figure 5:
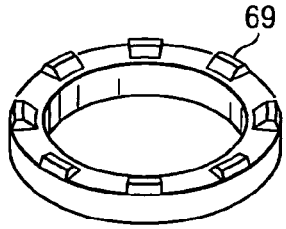
FIG. 5 is an isolated view of the thrust tower device used in the regenerative turbine section of the pump.

As can be seen in FIG. 3, each of the base plate 39, intermediate plates 45, 47 and discharge plate 57 also has a plurality of centrally located thrust towers (such as thrust towers 69, 71 in FIG. 3). As shown in FIGS. 4 and 5, the thrust tower 69 can be machined from a separate ring element which is received within a circular groove 73 on the respective opposing face of the plate under consideration. Alternatively, the thrust tower 69, 71 can be machined directly into the opposing faces 75, 77 of the respective plate.

As can be seen in FIG. 3, the thrust towers 69, 71 are arranged in a circumferential pattern on each of their respective planar faces of the plate. The thrust towers serve to support the impellers 43 while allowing rotational movement of the impellers relative to the scraper rings within the regenerative turbine section of the pump. In the example illustrated, the tower contact surfaces are approximately 0.050 inches wide, 0.050 inches tall and 0.133 inches long.

Figure 11:
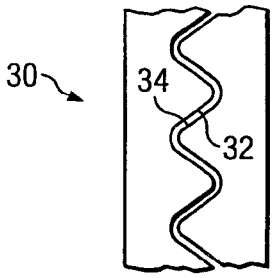
FIG. 11 is a partial sectional view of a labyrinth seal of the type which can be employed in the turbine section of the pump.
Figure 12:
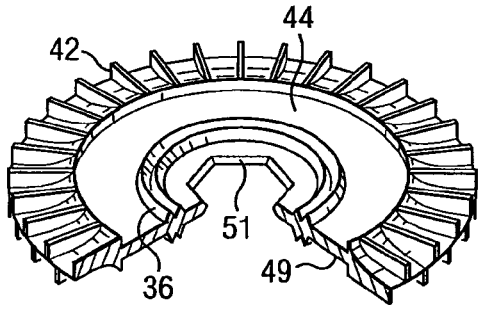
FIG. 12 is a view of a turbine impeller similar to FIG. 9, but showing a labyrinth seal added to either of the two opposing faces thereof.
Figure 13:
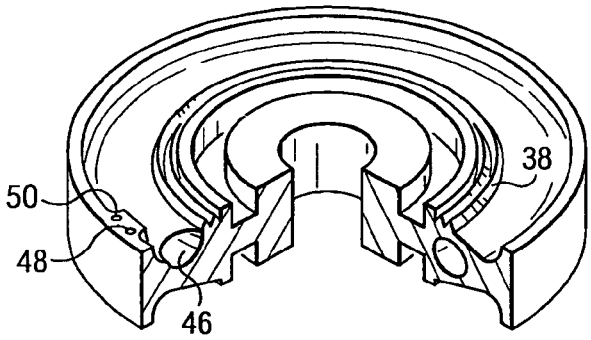
FIG. 13 is a view of an intermediate plate of the pump showing the mating labyrinth seal added to the top face thereof.

FIGS. 11-13 illustrate another embodiment of the invention in which the impellers, intermediate, suction and discharge plates are provided with "labyrinth" seal structures. FIG. 11 is a simplified view of the engagement surfaces of a typical labyrinth seal 30 showing the respective convoluted surfaces 32, 34 thereof. The convolutions 32, 34 constitute annular rings or sealing grooves which are machined into the respective surfaces. The grooves intermesh without metal-to-metal or plastic-to-plastic contact, to form a labyrinth seal created by the thin film of liquid within the grooves. Friction and wear are thereby minimized. FIG. 12 shows the planar surfaces of the opposing sides 44, 49 of the impeller each being provided with one half of the labyrinth seal structure 36. The mating seal structure is provided, for example, as shown at 38 on the intermediate plate shown in FIG. 13.

The basic operation of the pump of the invention will now be described. The pump motor is totally submersed by being placed in a well in a location that is past the "screened" water. The screened water reaches the base plate and enters the pump through the base plate inlet port. Water fills that pumping chamber first, then subsequent chambers quickly and become submerged. When the pump motor is activated, the driveshaft spins, driving each of the impellers. Each impeller applies a centrifugal force to the water in its respective pumping chamber, which water is then forced into the peripheral "raceway" where the water is directed again to the impeller for another pressure building engagement. This "regeneration" of engagement can happen several times before the pressurized water leaves that pump chamber and assists in building pressure. As pressure requirements increase, more regeneration occurs. This pressurized water is then directed to the next stage (impeller) for more pressurization. As the water is displaced by centrifugal force from the pumping chambers, fresh water follows for displacement by centrifugal force.

When the pump is turned off, water drains out of the regenerative turbine section of the pump backwards so that there is no pressure head to overcome in restarting the pump. This is to be contrasted with a positive displacement pump where the column of water on the pump constitutes a pressure head which must be overcome when the pump starts back up.

To use another example, the water enters each stage near the impeller outside diameter and is accelerated through something on the order of 330° of rotation before exiting the outlet of that stage at or near the same radius as the inlet. A sector of about 30° separates the inlet from the outlet. In each stage, the scraper ring interior diameter is located in very close proximity to the rotating impeller to minimize leakage between the high pressure exit and the inlet to the regenerative section of the pump. This action is to be contrasted to the traditional centrifugal pump in which fluid enters the impeller adjacent to the shaft centerline and is then accelerated outward, exiting the impeller at its outside diameter.

While not wishing to be bound by any particular theory of the regenerative principle, most experts seem to agree that the head building ability of the pump is related to the regenerative aspect of the fluid flow, whereby fluid enters an impeller blade (vane) and is accelerated not only tangentially in the direction of rotation, but also radially outward into the casing channel by centrifugal force. As the fluid strikes the internal diameter of the scraper ring, it is redirected back onto an adjacent blade whereby additional energy is imparted. This process repeats itself multiple times during a single rotation of a single impeller vane.

An invention has been provided with several advantages. Applicant's unique pump design offers the primary advantage of a high head at a low flow in a small space. Another advantage of the regenerative turbine pump of the invention is a very steeply rising head curve between minimum and maximum flow. This provides for very accurate flow control and very stable operation. The unique features of Applicant's particular design include the fact that the pump major operative components are designed in an "on-axis" configuration. That is, base plate, impellers, intermediate plates and discharge plate are all enclosed in a cylindrical housing and are co-incident along a vertical axis. The motor driveshaft lies "on axis" and connects to the impellers so that the rotation of the driveshaft drives the impellers.

Applicant's pump design is also naturally load matched. As demand increases, the regenerative action of the pump increases. Partly for this reason, the design can be powered from a low power source, such as a solar panel. Solar powered pumping is a variable speed application. Speed directly affects the pumping capacities and head capabilities of any given impeller. Thus, Applicant's submersible pump is sized to smaller capacities than might otherwise be available for a particular end application, while simultaneously compounding the pressure building capabilities (head) of the pump. The result is a design which aligns performance and allows the use of a more economical solar array, which typically constitutes the bulk of the cost of a remote pump system. Pump speeds can vary from approximately 1500 rpm to approximately 3400 rpm and are varied automatically by virtue of the intensity of the sunlight available to the solar panel or the available wind speed.

The suction case of the device can be equipped with a velocity reduction tube and/or a pleated stainless steel cartridge sediment screen. The design also features a "floating" impeller design, which allows for a degree of "centralization" and "forgiveness" of any unlikely foreign matter while simultaneously providing a virtually friction free rotation. A machine tuned and precision threaded stainless steel drive shaft provides precision trueness for peripherally equalized bearing loading.

The base, intermediate and discharge plates are equipped with a plurality, e.g., eight, thrust buffer towers which allow the impellers a small (e.g., 0.002 inch) clearance top and bottom. Three different styles of scraper rings can be utilized: (1) conventional; (2) parallel configuration; and (3) in-series configuration. Styles (2) and (3) can be utilized to allow for even greater pressures due to enhanced flow guidance and compounded engagement in the internal pump chamber.

If desired, the regenerative turbine design of the invention can be utilized in combination with other styles of pumps (as a semi-positive displacement pump), offering several of the advantages of a semi-positive design. The on-axis running characteristics of Applicant's design is one of the benefits of a centrifugal style pump, so that the combination of these two styles offers a hybrid design with advantages of both designs.

While the primary intended application is for a water well, the pump can be adapted for use in other areas such as an agricultural spray pump, an RV demand pump, a domestic demand pump, an industrial RO booster pump, etc.

While the invention has been shown in only one of its forms, it is not thus limited but is susceptible to various changes and modifications without departing from the spirit thereof.

What is claimed is:

1. A water well pump used to supply water in a high pressure head, low flow rate application from a downhole subterranean location within a wellbore to a surface location by means of surface plumbing, the pump comprising:

an electric motor positionable within the wellbore and having an associated electrical supply cable extending from the well surface to the downhole location for supplying electric current to the motor, the electric motor having a rotatably driven output shaft, the shaft extending outwardly from the motor generally along a vertical axis generally parallel to a central axis of the wellbore;

a pump sleeve and associated suction case generally aligned along the axis of the motor output shaft, the suction case having at least one opening for receiving well water;

at least two regenerative turbine stages contained in a stacked arrangement within the pump sleeve and coupled to the shaft for rotary motion as the motor drives the shaft, the regenerative turbine stages forming a regenerative turbine section of the pump having an inlet port for receiving well water from the suction case and having an outlet port connected to the surface plumbing for supplying well water to the surface location, the regenerative stages being arranged in an on-axis configuration co-incident along the vertical axis of the rotatably driven shaft;

wherein the regenerative turbine stages include a plurality of impellers separated by intermediate plates, the impellers having a series of discrete linear blade shaped peripheral turbine vanes each having a blade length and a blade height located on each of opposing sides thereof and fanning outward in an outwardly directed radial pattern for moving water through the regenerative turbine section of the pump;

wherein each impeller is surrounded peripherally by a scraper ring which is held in position by adjacent upper and lower intermediate plates, and wherein the scraper ring mates with the impeller to form a circumferential channel for regenerated water to pass about the periphery of the impeller as it passes between the inlet port and the outlet port of the regenerative section of the pump;

wherein each intermediate plate has opposing planar faces which are defined between a solid thickness of the respective plate, and wherein each opposing planar face is equipped with a plurality of centrally located thrust towers which are arranged in a circular pattern on each planar face, the thrust towers serving to support the impellers while allowing rotational movement of the impellers relative to the scraper rings within the regenerative turbine section of the pump, the thrust towers comprising upwardly extending protrusions arranged at spaced intervals in the circular pattern on each of the opposing planar faces of the intermediate plates, the circular pattern of the thrust towers being located radially inward of the peripheral turbine vanes present on the impellers when the impellers and intermediate plates are assembled; and wherein each intermediate plate has an internal passageway which forms a channel through the solid thickness of the plate and which communicates with the opposing planar faces in order to direct water from one peripheral location at a passageway inlet on one planar face to another peripheral location at a passageway outlet on the opposing planar face, wherein water enters each impeller of the regenerative turbine section at an inlet location near an outside diameter of each impeller, is accelerated about the periphery of the impeller before then exiting at a radial location which is at or near the same radial location on the impeller as the inlet location, creating a regenerative turbine action for imparting energy to the water.

2. The water well pump of claim 1, wherein the electric motor is powered from a harvested energy source selected from the group consisting of solar panels and windmill generated energy sources.

3. In combination, a water well pump and associated power supply used to supply water in a high pressure head, low flow rate application from a downhole subterranean location within a generally vertical wellbore to a surface location by means of surface plumbing, the pump comprising:

an electric submersible motor positionable within the wellbore and having an associated supply cable extending from the power supply at the well surface to the downhole location for supplying electric current to the motor, the power supply comprising a harvested energy source selected from the group consisting of solar panels and windmill generated energy sources, the electric motor having a rotatably driven output shaft, the shaft extending outwardly from the motor generally along a vertical axis with respect to a central vertical axis of the wellbore;

a cylindrical pump sleeve and associated cylindrical suction case generally aligned along the vertical axis of the motor output shaft, the suction case having at least one opening for receiving well water;

at least two regenerative turbine stages contained in a stacked arrangement within the pump sleeve and coupled to the shaft for rotary motion as the motor drives the shaft, the regenerative turbine stages forming a regenerative turbine section of the pump having an inlet port for receiving well water from the suction case and having an outlet port connected to the surface plumbing for supplying well water to the surface location, the regenerative stages being arranged in an on-axis configuration co-incident along the vertical axis of the rotatably driven shaft;

wherein the regenerative turbine stages include a plurality of impellers separated by intermediate plates, the impellers having a series of discrete linear blade shaped peripheral turbine vanes each having a blade length and a blade height located on each of opposing sides thereof in an outwardly directed radial pattern for moving water through the regenerative turbine section of the pump between the inlet port and outlet port thereof;

wherein each impeller is surrounded peripherally by a scraper ring which is held in position by adjacent upper and lower intermediate plates, and wherein the scraper ring mates with the impeller to form a circumferential channel for regenerated water to pass about the periphery of the impeller as it passes between the inlet port and the outlet port of the regenerative section of the pump;

wherein each intermediate plate has opposing planar faces which are defined between a solid thickness of the respective plate, and wherein each opposing planar face is equipped with a plurality of centrally located thrust towers which are arranged in a circular pattern on each planar face, the thrust towers serving to support the impellers while allowing rotational movement of the impellers relative to the scraper rings within the regenerative turbine section of the pump, the thrust towers comprising upwardly extending protrusions arranged at spaced intervals in the circular pattern on each of the opposing planar faces of the intermediate plates, the circular pattern of the thrust towers being located radially inward of the peripheral turbine vanes present on the impellers when the impellers and intermediate plates are assembled; and wherein the regenerative turbine stage includes a base plate having the inlet port for receiving well water and a discharge plate having the outlet port, wherein each intermediate plate has an internal passageway which forms a channel through the solid thickness of the plate and which communicates with the opposing planar faces in order to direct water from one peripheral location at a passageway inlet on one planar face to another peripheral location at a passageway outlet on the opposing planar face, wherein water enters each impeller of the regenerative turbine section at an inlet location near an outside diameter of each impeller, is accelerated about the periphery of the impeller before then exiting at a radial location which is at or near the same radial location on the impeller as the inlet location, creating a regenerative turbine action for imparting energy to the water.

4. The water well pump of claim 3, wherein the suction case carries a pleated filter screen for filtering large debris from the water entering the regenerative turbine section of the pump.

5. The water well pump of claim 3, wherein each scraper ring has at least one scallop at a given interior circumferential location about the periphery of the ring which forms an inlet and outlet path for regenerated water as it passes through one stage of the multi-stage regenerative section of the pump.

6. The water well pump of claim 3, wherein the impellers, intermediate plates, suction plate and discharge plate are each provided with mating labyrinth seal structures.

7. The water well pump of claim 3, wherein a velocity reduction tube is mounted onto the suction case of the pump for reducing the velocity of the water entering the pump in order to cause entrained sediment to drop out of the water.

* * * * *